US009187707B2

(12) United States Patent
Randisi, Sr.

(10) Patent No.: US 9,187,707 B2
(45) Date of Patent: Nov. 17, 2015

(54) LUBRICATING COMPOSITION AND METHOD FOR PREPARING SAME

(71) Applicant: Sal A Randisi, Sr., St. Petersburg, FL (US)

(72) Inventor: Sal A Randisi, Sr., St. Petersburg, FL (US)

( * ) Notice: Subject to any disclaimer, the term of this patent is extended or adjusted under 35 U.S.C. 154(b) by 414 days.

(21) Appl. No.: 13/694,911

(22) Filed: Jan. 18, 2013

(65) Prior Publication Data

US 2014/0206584 A1 Jul. 24, 2014

(51) Int. Cl.

| | |
|---|---|
| ***C10M 125/26*** | (2006.01) |
| ***C10M 113/12*** | (2006.01) |
| ***C10M 177/00*** | (2006.01) |
| ***C10M 169/06*** | (2006.01) |

(52) U.S. Cl.

CPC ..... *C10M 177/00* (2013.01); *C10M 169/06* (2013.01); *C10M 2201/1056* (2013.01); *C10M 2203/1006* (2013.01); *C10M 2205/022* (2013.01); *C10M 2205/026* (2013.01); *C10M 2205/0213* (2013.01); *C10M 2205/0285* (2013.01); *C10M 2207/026* (2013.01); *C10M 2209/084* (2013.01); *C10M 2209/104* (2013.01); *C10M 2213/062* (2013.01); *C10N 2230/06* (2013.01); *C10N 2230/70* (2013.01); *C10N 2230/74* (2013.01)

(58) Field of Classification Search

CPC ..... C10M 2201/1056; C10M 2201/1026
USPC ..... 508/136–148
See application file for complete search history.

(56) References Cited

U.S. PATENT DOCUMENTS

| | | | | |
|---|---|---|---|---|
| 5,236,606 | A * | 8/1993 | Rangel | 508/161 |
| 5,358,664 | A * | 10/1994 | Brauer | 516/109 |
| 6,455,623 | B1 * | 9/2002 | Howard | 524/474 |
| 8,188,021 | B2 * | 5/2012 | Chu et al. | 508/542 |
| 8,486,878 | B2 * | 7/2013 | Shan et al. | 508/591 |
| 8,492,322 | B2 * | 7/2013 | Shan et al. | 508/591 |
| 8,697,752 | B2 * | 4/2014 | Numata | A01N 25/04 514/627 |
| 8,735,427 | B2 * | 5/2014 | Numata | A01N 25/04 514/321 |
| 8,975,218 | B2 * | 3/2015 | Ikuma et al. | 508/591 |
| 2005/0137290 | A1 * | 6/2005 | Hagen | C80L 53/02 523/219 |

* cited by examiner

*Primary Examiner* — Ellen McAvoy
(74) *Attorney, Agent, or Firm* — Feldman Law Group, P.C.; Stephen E. Feldman

(57) ABSTRACT

A composition made by admixing a major amount of base oils of lubricating viscosity and minor amounts of additives. The additives can include a viscosity modifier, a dispersant, a friction modifier, an anti-oxidant, a suppressant, a tackifier, and thickeners. The dispersant can be a dissolved powered styrene-ethylene/propylene-block copolymer and the thickeners can be fumed silicia. The dispersants and the thickeners are pulverized and dissolved in the composition to provide for inhibition of oil separation during storage.

23 Claims, 5 Drawing Sheets

LUBRICATING COMPOSITION AND METHOD FOR PREPARING SAME

FIELD

The present invention relates to a lubricating composition and a method for preparing the lubricating composition. More specifically, the disclosed technology relates to a stable and performance-enhanced lubricating composition that retains its lubricating properties even after a long period of storage without any significant separation or loss of oil.

BACKGROUND

Lubricants such as lubricating oil and grease are used to reduce friction between moving parts. Grease is a solid to semifluid product that consists of a base oil, thickener and additives. Grease is made by dispersing a thickening agent in the lubricating oil. Most grease thickeners are soap, for example, aluminum, calcium or lithium soap. In addition, various polymeric thickeners or viscosity improvers have been used to impart consistency to the lubricating oils and greases.

Lubricating greases release oil when stored for long periods of time. The degree of oil separation depends upon multiple factors, such as, the thickener used, the base oil used and the manufacturing method itself. When manufacturing grease, it is important for the grease to have a proper balance between thickeners and base oils because if the content of base oil is increased and amount of thickener is decreased then base oil will be loosely held and is easily separated.

Hence there is a need to prepare a stable and performance enhanced lubricating composition that retains its properties even on storage without significant separation or loss of oil.

SUMMARY

In one implementation, the disclosed technology provides a composition comprising, or made by admixing a major amount of: base oils of lubricating viscosity and minor amounts of additives, e.g., a viscosity modifier, a dispersant, a friction modifier, an anti-oxidant, a suppressant, a tackifier, and thickeners.

The dispersant can be a powdered styrene-ethylene/propylene-block copolymer and the thickeners can be fumed silicia. The dispersants and the thickeners can be pulverized and dissolved in the composition to provide for inhibition of oil separation during storage.

The base oils of the composition may be mineral oil and polyalphaolefin (PAO) oil; the suppressant may be polyethylene glycol; the viscosity modifier may be polyalkyl methacrylate; the tackifier may be polyisobutylene dissolved in a selected paraffinic-based stock; the friction modifier may be polytetrafluoroethylene; and the antioxidant may be a phenolic antioxidant.

In another implementation, the disclosed technology may provide a process for making a composition. The composition may be formulated by adding a viscosity modifier to a kettle. A first base oil is then added to the kettle and mixed with an anchor blade and a disperser blade. A second base oil is then added to the kettle and a speed of the disperser blade is increased.

An antioxidant and a friction modifier is then added to the kettle and a vacuum is created within the kettle through the use of a rotor/stator assembly. A dispersant is then added to the composition through a vacuum wand. The vacuum wand allows the dispersant to be introduced directly into the rotor/stator assembly so that the dispersant is pulverized, discharged and dissolved under the surface of the oil. A speed of the rotor/stator assembly is then reduced so that thickeners can be added through the vacuum wand. The vacuum wand allows the thickeners to be introduced directly into the rotor/stator assembly so that the thickeners are pulverized, discharged and dissolved under the surface of the oil. Once added, the rotor/stator assembly is shut down and a tackifier and a suppressant is added through a cover port. A vacuum is then created to eliminate air from the composition.

In another implementation, a lubricating formulation can be prepared from a blend of components comprised of: 35-55% mineral oil; 30-50% PAO oil; 0.5-5% powdered styrene-ethylene/propylene-block copolymer; 0.5-5% of a fumed silica aftertreated with Dimethyldichlorosilane; and 1-10% of a hydrophilic fumed silica with a specific surface area of 200 m2/g, wherein the powdered styrene-ethylene/propylene-block copolymer, fumed silica aftertreated with Dimethyldichlorosilane and the hydrophilic fumed silica with a specific surface area of 200 m2/g are introduced directly into a rotor/stator so that the powdered styrene-ethylene/propylene-block copolymer, fumed silica aftertreated with Dimethyldichlorosilane and the hydrophilic fumed silica with a specific surface area of 200 m2/g are pulverized, discharged and dissolved under the surface of the blend during formulation.

Other additives may include 0.1-2% of polyethylene glycol; 0.1-2% polyalkyl methacrylate; 0.1-2% polyisobutylene dissolved in a selected paraffinic-based stock; 0.5-5% polytetrafluoroethylene; and 0.1-2% of a phenolic antioxidant.

DETAILED DESCRIPTION

Figure 1:
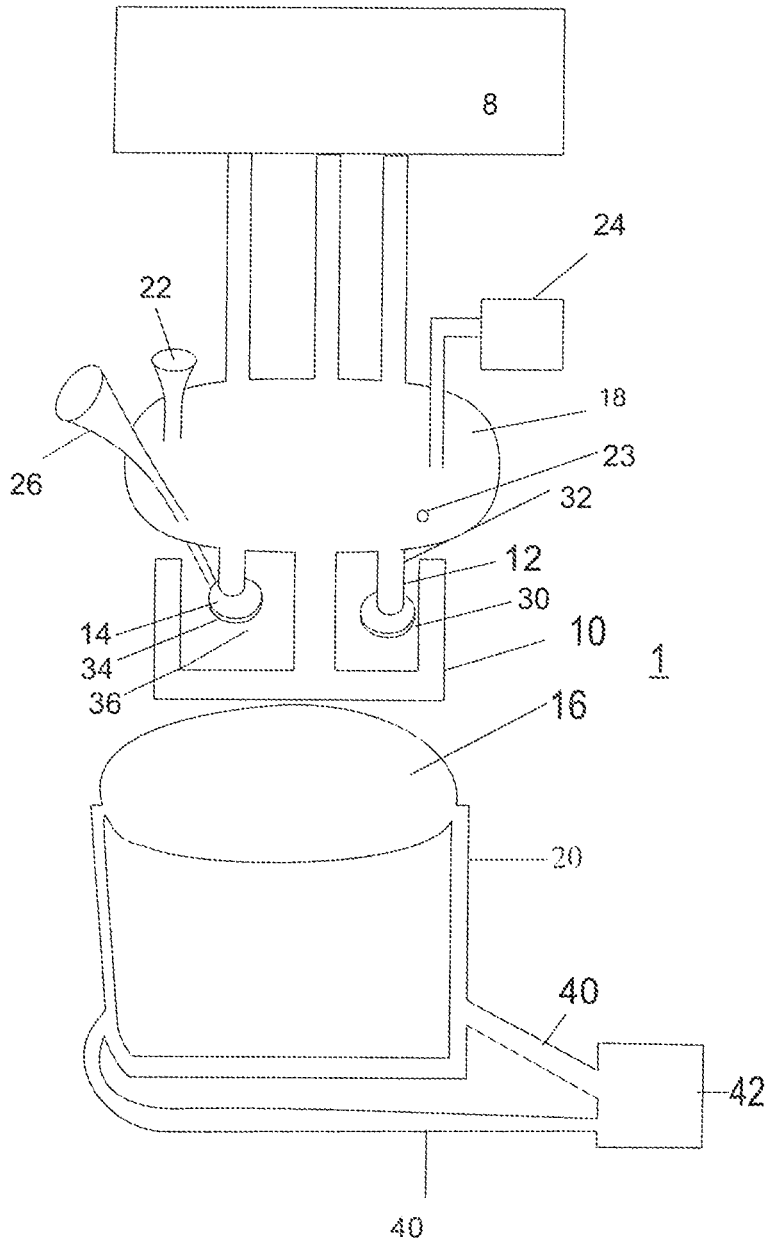
FIG. 1 is a perspective view of a mixer used in preparing a composition.

A multi-shaft mixer 1 can be used to prepare a lubricating composition. A multi-shaft mixer 1 can include an anchor agitator 10 that works in combination with a disperser shaft 12 and a rotor/stator assembly 14 for increased shear input. The anchor agitator 10, the disperser shaft 12 and rotor/stator assembly 14 are rotated by motor assembly 8.

The multi-shaft mixer 1 can also include a kettle 16, a kettle cover 18, a kettle jacket 20, cover ports 22, a metered diaphragm pump 24, and a vacuum wand 26. The vacuum wand 26 allows for the incorporation of powders directly into the rotor/stator assembly 14.

The anchor agitator 12 can feed product into the high speed disperser blade 14 and rotor/stator 16 and ensure that the mixture is constantly in motion. The anchor blade 12 can also be provided with scrapers to remove materials from the interior vessel walls to enhance the heat transfer capabilities of the mixer 1.

The high speed dispersers 14 can include a driven vertical shaft 32 and a high shear disk type blade 30. The blade 30 can rotate at up to 5000 RPM and create a radial flow pattern within a stationary mix vessel. The blade 30 can also create a vortex that pulls in the contents of the vessel to the blades sharp edges. The blade surfaces mechanically tear apart solids thereby reducing their size, and at the same time dispersing them among the liquid used as the carrier fluid.

The high shear rotor-stator mixer 16 can include a single stage rotor that turns at high speed within a stationary stator.

As the rotating blades pass the stator, they mechanically shear the contents. The rotor/stator 16 can also generate an intense vacuum that sucks in powders and liquids into the rotor-stator area. A vacuum wand 26 can provide a path to inject powders and/or solids directly into the stream. This allows the powders and/or solids to be combined and mixed into the flowing stream at the same point.

In accordance with the disclosed technology, the process for preparation of the lubricating composition can be carried out in the multi-shaft mixer.

Figure 2A:
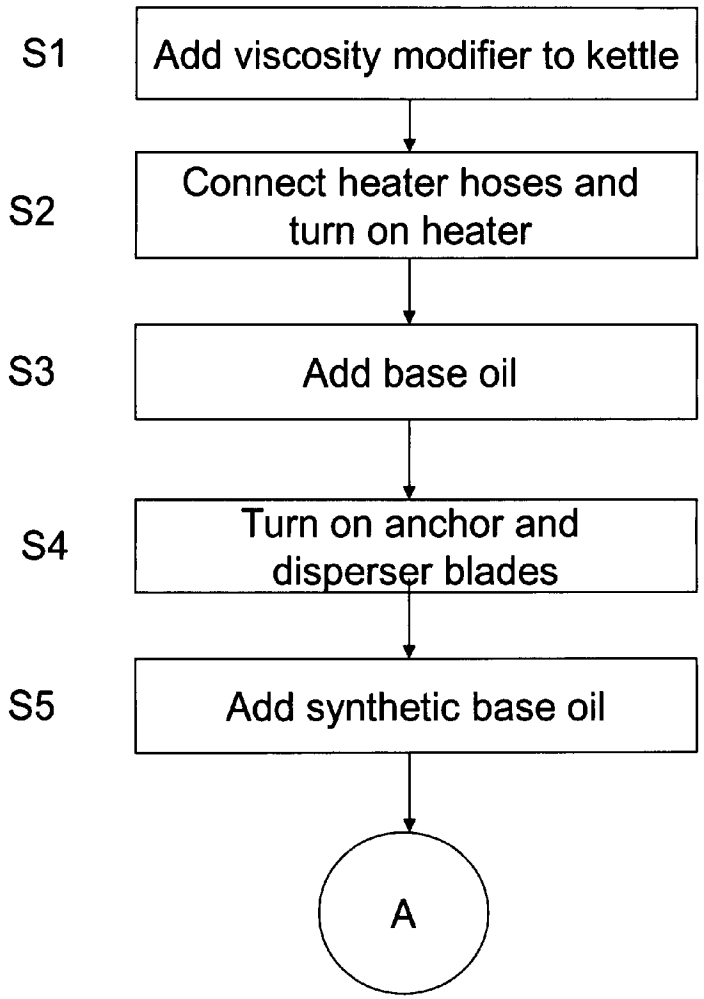
FIGS. 2*a-d* are flow charts showing an example process of preparing a composition.
Figure 2B:
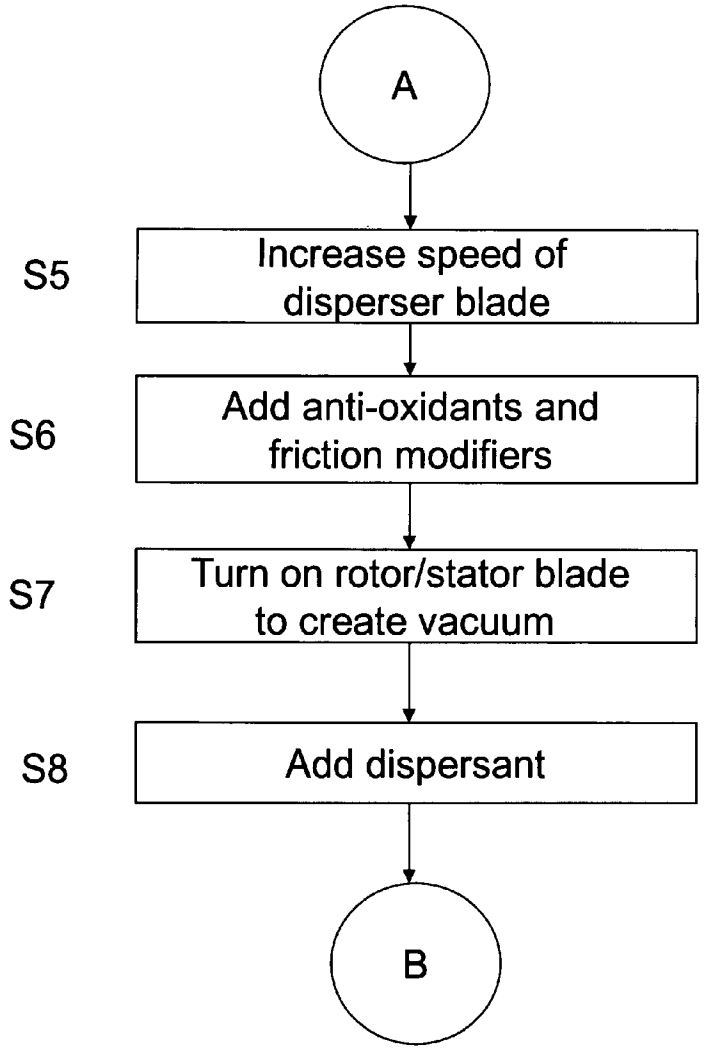
Figure 2C:
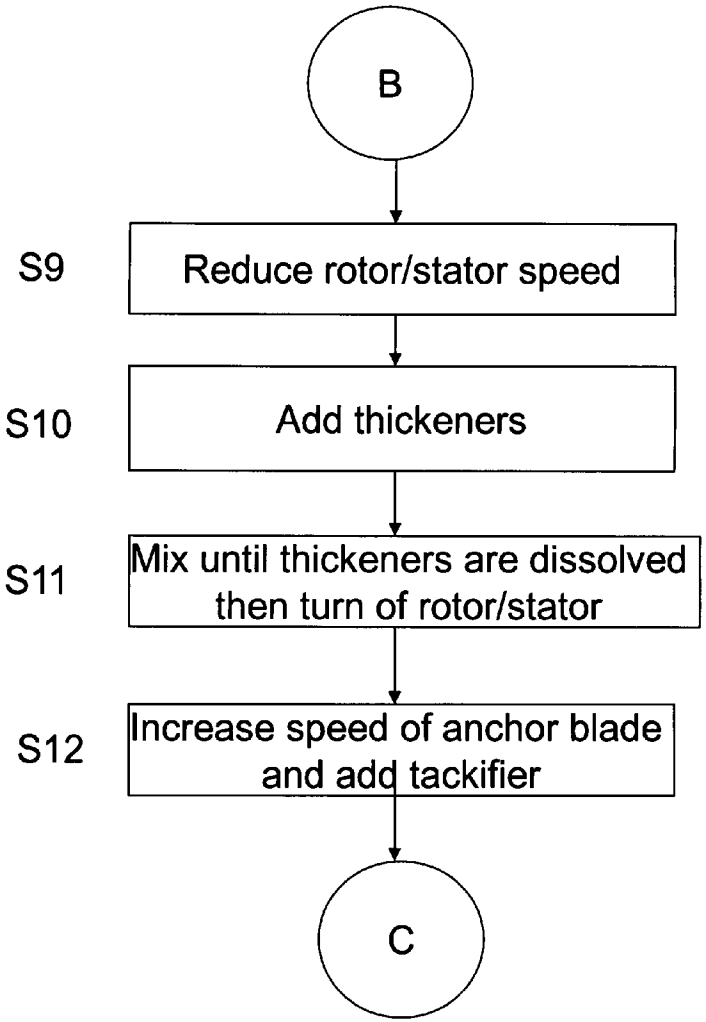
Figure 2D:
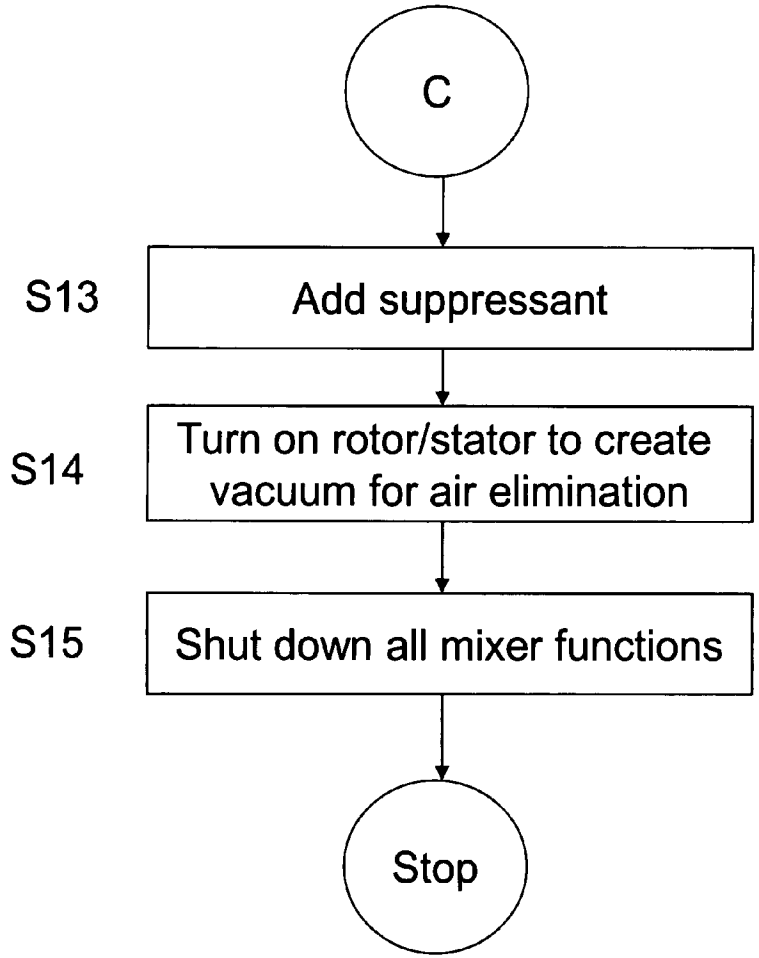

In one implementation, as shown in FIG. 2*a-d*, a viscosity modifier is added to an open kettle. (Step 1). The viscosity modifier can be an additive based on polyalkyl methacrylate (PAMA), such as, VISCOPLEX®. However, other types of viscosity modifiers are contemplated. This type of viscosity modifier enables better oil flow at low temperatures. In addition, the viscosity modifier ensures adequate lubrication at high temperatures. The viscosity modifier also has the added virtue of lowering the operating temperature and dispersing soilants and soot, which greatly prolongs the service life of both lubricants and machines, as well as reducing oxidation and deposits.

Hot oil hoses 40 are connected to the kettle jacket 20 and kettle heaters 42 are turned on to circulate hot oil throughout the kettle jacket 20 at a temperature of about 325° F. The cover of the kettle is also closed at this time. (Step 2).

In Step 3, a base oil is metered into the kettle 16 by a metered diaphragm pump 24. The base oil may be a mineral oil that is used as a fluid component of the composition. The anchor blade is turned on at a speed of 10-12 RPM and the dispersion blade is set at 900-1000 RPM. (Step 4).

In Step 5, a synthetic base oil is metered into the kettle 16 by a metered diaphragm pump 24. The synthetic base oil can be a polyalphaolefin (PAO) oil. The disperser blade is increased to 1200-1250 RPM. (Step 6).

In Step 7, antioxidants and/or friction modifiers can be added to the mixture through cover ports 22. The antioxidant can be a phenolic antioxidant, for example, IRGANOX® L115. Phenolic antioxidants enhance the performance of the lubricant formulations by improving the thermal stability as measured by viscosity control and deposit formation tendencies. The friction modifier can be a solid lubricate, e.g., polytetrafluoroethylene (PTFE). This type of friction modifier reduces the coefficient of friction. The speed of the dispersion blade disperses the antioxidant and friction modifier into the composition.

In Step 8, a rotor/stator high shear mixer 14 is set to about 3300-3800 RPM and the kettle 16 is vented at vent 23. This creates a vacuum at the vacuum wand 26. The vacuum is generated by, and within, the high shear mixer. Its shearing action displaces material from the mixer housing causing a vacuum at the inlet wand, drawing powders into the mixer, pulverizing them, and discharging them under the surface of the oil.

In Step 9, a dispersant, such as, powdered styrene-ethylene/propylene-block copolymer is vacuumed into the mixture, e.g. for example, KRATON® G1701 is added using high shear mixer and vacuum wand. The composition is mixed until batch temperature reaches about 130 degrees F. It is worthy to note that if the mixer is run too fast, the powders will be sucked in and blown out of the vent. It is critical to adjust the rate of powder induction so that there is time for the powders to be absorbed by the oil. This assures that the antioxidants, dispersants and thickeners have melted and/or dissolved and are completely dispersed into the mixture.

In Step 10, the speed of rotor/stator high shear mixer is reduced to 1300-1400 RPM, and the vacuum valve is adjusted to allow thickeners to be added slowly to batch through vacuum wand. The thickeners can be a silicon dioxide powder, e.g., a fumed silica aftertreated with DDS (Dimethyldichlorosilane), such as, AEROSIL® R 972. This thickener keeps particles in suspension and prevents hard sediments from forming.

A second thickener can also be vacuumed into the mixture. The second thickener can also be a silicon dioxide powder, e.g., a hydrophilic fumed silica with a specific surface area of 200 m2/g, such as, AEROSIL® 200. This thickener keeps particles in suspension, prevents hard sediments from forming and increases viscosity of the mixture. When introducing the AEROSIL® 200, to prevent the AEROSIL® 200 from being exhausted out the vent by too much velocity. The AEROSIL® 200 must be injected slow enough to allow for it to be absorbed into the mixture. To achieve this, the second thickener may be added in several parts instead of all at once. The high shear mixer runs until all the AEROSIL® 200 has been introduced into the batch. Then the high shear mixture is turned off and the vacuum valve is closed.

In Step 11, the anchor blade speed is increased to 28-30 RPM and the batch is mixed until a temperature of about 270 degrees F. is reached. In Step 12, a tackifier is added through cover port and mixed for 5 minutes. For example, PARATAC® is a tackifier derived from a non-polar, non-toxic and odorless, high molecular weight polyisobutylene dissolved in a selected paraffinic-based stock. It offers exceptional binding and adhesive properties for lubricant applications.

In Step 13, a suppressant is added through the same port and mixed for an additional 5 minutes. The suppressant can be polyethylene glycol, e.g. P-2000. Polyethylene glycol are water-soluble liquids or waxy solids used as emulsifying or wetting agents. Polypropylene glycols also suppress foaming.

In Step 14, the high shear mixer is set at 3300-3800 RPM. The batch is mixed for five minutes and the formulation is subjected to vacuum to eliminate air.

In Step 15, after complete mixing, anchor and disperser blades are shut down, the oil hoses are disconnected, the cover is opened and a sample is taken for lab analysis to ensure batch meets requirements. Once approved, the batch is processed for packaging. The batch is then a stable and performance enhanced lubricating composition that retains its properties even on storage without significant loss of oil.

The advantages of the disclosed process is that the rotor/stator high shear mixer is performs two functions. Firstly, it creates a vacuum to introduce additives such as Kraton®, PTFE, Aerosil® and Irganox® below the surface of the oil that enhances the emulsification and dispersion of the additives into the mixture. Secondly, it grinds the granular additives, such as Kraton®, into much smaller particle sizes, that speeds and enhances the incorporation of the particles into the mixture. The rotor/stator high shear mixer is preferably operated at 3549 RPM in the grinding mode in the early stages of batching, but is reduced to 1350 RPM with the inlet valve throttled down.

The anchor starts at 10-12 RPM and acts only as a scraper during early mixing, keeping the vessel walls and bottom clean. After all the Aerosil® has been vacuumed in, and the mixture consistency is thickened, the anchor speed is increased to 28-30 RPM that aids in the blending process, in addition to wiping the walls and bottom of the vessel.

The invention is further elaborated with the help of following example. However, it is understood that this example should not be construed to limit the scope of the invention.

EXAMPLE 0.564 percent by weight of Viscoplex was added to an open kettle. Cover of the kettle was closed and hot oil hoses were connected to kettle jacket. Hot oil was circulated at 325° F. through the jacket. Cover vent was opened. 46.323 percent by weight of mineral oil was added to the kettle. Anchor blade was started at 10-12 RPM. Disperser blade was started at 900-1000 RPM. 38.884 percent by weight of PAO oil was added to the kettle. Speed of disperser blade was increased up to 1200-1250 RPM. 0.211 percent by weight of Irganox and 2.254 percent by weight of PTFE were added to the mixture through access port in cover. The mixture was mixed in high shear mixer at 3549 RPM generating vacuum at wand. 2.254 percent by weight of Kraton was added later through a vacuum wand and batch temperature was allowed to reach 130° F. The speed of high shear mixer was reduced to 1350 RPM. Mixer valve was opened just enough to allow low level of vacuum to be drawn, to prevent escape of Aerosil powders from the kettle cover vent. 2.818 percent by weight of Aerosil R-972 and ⅓ of 5.635 percent by weight of Aerosil A-200 were added to the mixer under vacuum. Mixing was carried out for additional 3 minutes. Remaining Aerosil A-200 was added to the mixer under vacuum. Mixture was again subjected to mixing for 3 minutes. High shear mixer motor was shut off and anchor speed was increased to 28-30 RPM. Mixing was continued further until batch temperature reached 270° F. Later 0.211 percent by weight of Paratac was added through cover access port. After mixing for 5 minutes, P-2000 was added through cover access port and vent cover was then closed. High Shear Mixer was again started to rotate at 3549 RPM for creating vacuum in kettle to remove air and continued to mix for 5 minutes. Anchor and disperser motors were then shut off. Hot oil hose valves were closed and hot oil hoses were removed from mixer kettle. Sample of batch were taken in sample cup by opening the cover and then preceded to lab for analysis.

The present invention has been described in an illustrative manner, and it is to be understood that the terminology used is intended to be in the nature of description rather than of limitation. It is not intended to be exhaustive or to limit the invention to the precise form disclosed. It is also to be understood that the following claims are intended to cover all of the generic and specific features of the invention described herein.

The invention claimed is:

1. A composition comprising, or made by admixing: a major amount of: base oils of lubricating viscosity; and minor amounts of a viscosity modifier, a dispersant, a friction modifier, an anti-oxidant, a suppressant, a tackifier, and thickeners, the dispersant is a powered styrene-ethylene/propylene-block copolymer and the thickeners are (a) a hydrophobic fumed silica and (b) a hydrophilic fumed silica, the dispersants and the thickeners are pulverized and dissolved in the composition to provide for inhibition of oil separation during storage.

2. The composition of claim 1 wherein the base oils are mineral oil and polyalphaolefin (PAO) oil.

3. The composition of claim 2 wherein the suppressant is polyethylene glycol.

4. The composition of claim 3 wherein the viscosity modifier is polyalkyl methacrylate.

5. The composition of claim 4 wherein the tackifier is polyisobutylene dissolved in a selected paraffinic-based stock.

6. The composition of claim 5 wherein the friction modifier is polytetrafluoroethylene.

7. The composition of claim 6 wherein the antioxidant is a phenolic antioxidant.

8. A process for making a composition comprising the steps of: adding a viscosity modifier to a kettle; adding a first base oil to the kettle; mixing the composition with an anchor blade and a disperser blade; adding a second base oil; increasing a speed of the disperser blade; adding an antioxidant and a friction modifier; creating a vacuum within the kettle through the use of a rotor/stator assembly; adding a dispersant through a vacuum wand, the vacuum rand allows the dispersant to be introduced directly into the rotor/stator assembly so that the dispersant is pulverized, discharged and dissolved under the surface of the oil; reducing a speed of the rotor/stator assembly; adding thickeners through the vacuum wand, the thickeners are (a) a hydrophobic fumed silica and (b) a hydrophilic fumed silica, the vacuum wand allows the thickeners to be introduced directly into the rotor/stator assembly so that the thickeners are pulverized, discharged and dissolved under the surface of the oil; shutting down the rotor/stator; adding a tackifier and a suppressant through a cover port; and creating a vacuum with the rotor/stator assembly to eliminate air from the composition.

9. The process of claim 8 wherein the first base oil is mineral oil and the second base oil is a polyalphaolefin (PAO) oil.

10. The process of claim 9 wherein t le dispersant is a powered styrene-ethylene/propylene-block copolymer.

11. The process of claim 10 wherein the hydro fumed silica is fumed silica aftertreated with Dimethyldichlorosilane and the hydrophilic fumed silica has a specific surface area of 200 m2/g.

12. The process of claim 11 wherein the suppressant is polyethylene glycol.

13. The process of claim 12 wherein the viscosity modifier is polyalkyl methacrylate.

14. The process of claim 13 wherein the tackifier is polyisobutylene dissolved in a selected paraffinic-based stock.

15. The process of claim 14 wherein the friction modifier is polytetrafluoroethylene.

16. The process of claim 15 wherein the antioxidant is a phenolic antioxidant.

17. A lubricating formulation prepared from a blend of components comprised of: 35-55% mineral oil; 30-50% PAO oil; 0.5-5% powered styrene-ethylene/propylene-block copolymer; 0.5-5% of a fumed silica aftertreated with Dimethyldichlorosilane; and 1-10% of a hydrophilic fumed silica with a specific surface area of 200 m2/g, wherein the powered styrene-ethylene/propylene-block copolymer, fumed silica aftertreated with Dimethyldichlorosilane and the hydrophilic fumed silica with a specific surface area of 200 m2/g are introduced directly into a rotor/stator so that the powered styrene-ethylene/propylene-block copolymer, fumed silica aftertreated with Dimethyldichlorosilane and the hydrophilic fumed silica with a specific surface area of 200 m2/g are pulverized, discharged and dissolved under a surface the blend during formulation.

18. The lubricating formulation prepared from a blend of components as claimed in claim 17 further comprised of 0.1-2% of polyethylene glycbl.

19. The lubricating formulation prepared from a blend of components as claimed in claim 18 further comprised of 0.1-2% polyalkyl methacrylate.

20. The lubricating formulation prepared from a blend of components as claimed in claim 19 further comprised of 0.1-2% polyisobutylene dissolved in a selected paraffinic-based stock.

21. The lubricating formulation prepared from a blend of components as claimed in claim 20 further comprised of 0.5-5% polytetrafluoroethylene.

22. The lubricating formulation prepared from a blend of components as claimed in claim 21 further comprised of 0.1-2% of a phenolic antioxidant.

23. The composition of claim 1 wherein the hydrophobic fumed silica is fumed silica aftertreated with Dimethyldichlorosilane and the hydrophilic fumed silica has a specific surface area of 200 m2/g.

* * * * *